United States Patent [19]

Okada et al.

[11] Patent Number: 4,677,449

[45] Date of Patent: Jun. 30, 1987

[54] PARTIALLY PRESSURE-SENSITIZED RECORDING PAPER AND PROCESS FOR PREPARING THE SAME

[75] Inventors: Yoshio Okada; Yuriko Igarashi, both of Iwaki, Japan

[73] Assignee: Kureha Kagaku Kogyo Kabushiki Kaisha, Tokyo, Japan

[21] Appl. No.: 793,913

[22] Filed: Nov. 1, 1985

Related U.S. Application Data

[62] Division of Ser. No. 661,157, Oct. 15, 1984, Pat. No. 4,597,993.

[30] Foreign Application Priority Data

Oct. 27, 1983 [JP] Japan ..... 58-201841

[51] Int. Cl.[4] ..... B41M 5/16; B41M 5/22

[52] U.S. Cl. ..... 503/206; 503/207; 503/214; 503/215

[58] Field of Search ..... 346/206, 207, 208, 209, 346/214, 215, 201; 427/43.1, 54.1, 150–152, 180, 202, 258, 261, 265, 288

[56] References Cited

U.S. PATENT DOCUMENTS 3,111,407 11/1963 Lindquist et al. ..... 430/158

4,091,122 5/1978 Davis et al. ..... 427/151

*Primary Examiner*—Bruce H. Hess

*Attorney, Agent, or Firm*—Oblon, Fisher, Spivak, McClelland & Maier

[57] ABSTRACT

Disclosed herein are a recording paper which is partially pressure-sensitized, comprising microcapsules containing a solution of a colorless color former, sheet material and binder, the microcapsules being fixed to a specified part of a surface of the sheet material via the binder painted on the specified part and majority of the fixed microcapsules having at least a part of the microcapsule exposed to outside of the binder, and a process for producing the recording paper which is partially specified.

5 Claims, 1 Drawing Figure

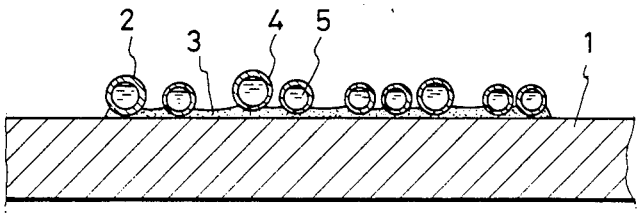
2
3
4
5
1

PARTIALLY PRESSURE-SENSITIZED RECORDING PAPER AND PROCESS FOR PREPARING THE SAME

This is a division, of application Ser. No. 661,157, filed Oct. 15, 1984 now U.S. Pat. No. 4,597,993.

BACKGROUND OF THE INVENTION

The present invention relates to a recording paper which is partially pressure-sensitized and a process for preparing thereof, and more in detail, relates to a recording paper which is partially pressure-sensitized obtained by retaining microcapsules containing a solution of a colour former on a specified part of a surface of a sheet material by the use of a binder, particularly a photosetting binder.

In recent years, the recording papers for computer or businessform such as slips for business have come to be more and more complicated and diversified in accordance with the improvement of business efficiency and mechanization of business, and a considerable number of the businessforms take the form including a plurality of copying sheets.

Although in such cases, the pressure sensitive recording paper is frequently used, the conventional pressure sensitive recording paper is made by piling an upper sheet of paper (hereinafter referred to CB sheet) having the back surface thereof painted with microcapsules containing a solution of the so-called leucotype dyestuff (as a colour-former) as the core substance onto a lower sheet of paper (hereinafter referred to as CF sheet) having the front surface thereof painted with acid clay or an acidic resin (as a developer), and in the actual use, by the application of writing pressure by a pen or printing pressure by a typewriter, the microcapsules at the pressed part(s) are broken to contact the colour former with the developer, thereby causing coloration and resulting in printing of the handwritten or typewritten items. In the case of pressure sensitive recording paper having a number of copying sheets, one or more sheets of paper each having both the front surface thereof painted with a developer and the back surface thereof painted with a colour former (hereinafter referred to as CBF sheet(s)) is or are inserted between the CB sheet and the CF sheet, and the thus prepared multi-layered paper is used for the purpose.

However, since the microcapsules have been painted on the whole surface of the sheet material, it is necessary to desensitize the developer on the part(s) of the surface of the sheet materrial by the use of a reducer ink (de-sensitizing ink) or the like in the cases where only a specified number of the sheets of recording paper should be copied or only specified part(s) of a slip should be copied, for preventing the unnecessary copying. Such a technique would require much labor and it is inevitable to waste the microcapsules on the part(s) not to be copied or on the number of sheets of copying paper by the de-sensitizing.

In view of the above-mentioned demerit of the conventional pressure sensitive recording paper, it is considered that a recording paper which is partially pressure-sensitized can be obtained without using any desensitizing ink, if it is able to retain the microcapsules only on the really necessary part of the surface of the DB sheet. Namely, in the case where a pressure sensitive recording paper having the microcapsules painted only on the necessary part(s) of the surface thereof can be prepared by a spot-printing method or the like, a really epoch-making pressure sensitive recording paper can be offered.

However, since at present the conventional pressure sensitive recording paper is prepared by painting a surface of base paper with an aqueous slurry-like material comprising a water-soluble binder, water as a solvent, adjuvants and the microcapsules, it is practically almost impossible to apply such a technique mentioned above to the spot-printing and the like, because the thus spot-printed sheet of paper partly wrinkles on drying.

On the other hand, from the economical viewpoint of not using the expensive microcapsules and the technical merits of copy-printing only on the necessary part of the surface, the development of the recording paper which is partially pressure-sensitized has been eagerly requested.

In answering the request, the processes for preparing the recording paper which is partially pressure-sensitized have been developed. As an example, a process wherein the microcapsules are dispersed in an organic solvent containing a vehicle and the thus obtained organic dispersion is painted only on the specified part(s) of the surface of sheet material by a printing machine of photogravure type or flexo type has been known.

However, on the recording paper which is partially pressure-sensitized obtained by the process of painting an organic dispersion of microcapsules in a solution of a vehicle on a sheet of paper and drying the thus painted paper, the whole surface of the microcapsule is covered by a binder and the microcapsules are fixed onto the surface of the sheet of paper and accordingly, the breaking efficiency of the microcapsules and the transfer efficiency from CB sheet to CF sheet are inhibited resulting in the necessity of painting a large amount of the microcapsules for obtaining a predetermined color density.

As a result of the studies of the present inventors concerning the above-mentioned several problems, it has been found that by a process comprising the steps of painting a binder on a specified part(s) of the surface of a sheet material, before solidifying of the thus painted binder, adhering the microcapsules only onto the thus specified part(s) of the surface where the binder has been painted and solidifying the binder, the recording paper which is partially pressure-sensitized showing an extremely high colouring density is obtained and based on the finding, the present inventors have attained the present invention.

BRIEF EXPLANATION OF DRAWING

Of the attached drawing, the FIGURE shows the partial and cross-sectional enlarged view of the recording paper which is partially pressure-sensitized according to the present invention, and the microcapsule 2 containing a solution of a colour former 5 as the core substance within the wall 4 of the microcapsule is adhered firmly onto the surface of the sheet material 1 via the binder 3. In the thus formed recording paper which is partially pressure-sensitized according to the present invention, the surface of the microcapsule 2 is not wholly covered with the binder 3, and almost all the microcapsules are adhered firmly to the binder 3 with only a part of the surface of each microcapsule and the remaining part of the surface of the microcapsule is exposed outside of the space occupied by the binder.

SUMMARY OF THE INVENTION

In a first aspect of the present invention, there is provided a recording paper which is partially pressure-sensitized, comprising microcapsules containing a solution of a colourless colour former, sheet material and binder, the microcapsules being fixed to a specified part of a surface of the sheet material via the binder painted on the specified part and majority of the fixed microcapsules having at least a part of the microcapsule exposed to outside of the binder.

In a second aspect of the present invention, there is provided a process for preparing a recording paper which is partially pressure-sensitized, comprising painting a specified part of a surface of a sheet material with a not-yet hardened binder adhering microcapsules containing a colour former therewithin to the not-yet hardened binder painted on the specified part of the surface of the sheet material and then fixing the microcapsules to the surface of the sheet material via the binder while hardening the not-yet hardened binder painted on the specified part of the surface of the sheet material so as to expose at least a part of a microcapsule to outside of the binder.

DETAILED DISCLOSURE OF THE INVENTION

The recording paper which is partially pressure-sensitized according to the present invention is prepared as follows.

A specified part of the surface of a sheet material is painted with a not-yet solidified binder, by a printing machine selected according to the viscosity of the not-yet solidified binder. Also another method of printing may be adopted. The amount of the binder to be painted is such that the microcapsules are firmly fixed to the surface of a sheet material after solidifying of the binder, which may be suitably determined.

The binder used in the present invention is preferably a photosetting resin, namely the binder which solidifies only when exposed to a strong ultraviolet light of a wave length in a range of 200 to 400 nm and contains as a major component an acrylic ester such as (1) polyol acrylates exemplified by dimethylolpropane triacrylate, trimethylolpropane triacrylate, pentaerythritol triacrylate, pentaerythritol tetraacrylate and dipentaerythritol hexaacrylate, (2) epoxyacrylates exemplified by bisphenol A glycidylether acrylate, modified bisphenol A epoxyacrylate, epoxydiacrylate and acrylate of epoxidized drying oil and (3) urethane acrylate exemplified by polyacrylate carbamate, and further contains as a fluidity-adjusting agent, one or more than two substances selected from the group consisting of cyclohexyl acrylate, benzyl acrylate, 2-ethylhexyl acrylate, 2-hydroxyethyl acrylate, styrene, N-methylolacrylamide, vinyl acetate, N-vinylpyrrolidone, ethyleneneglycol diacrylate, diethyleneglycol diacrylate, butyleneglycol acrylate and 1,4-butanediol diacrylate as well as one or more than two polymerization assistants selected from the group consisting of methyl o-benzoyl benzoate, thioxanthone, 2-chlorothioxanthone, p-dimethylaminobenzaldehyde, dimethylaminoethane, benzophenone and diethoxyacetophenone. According to necessity, an inhibitor of thermal polymerization, a chain-transfer agent and one or more than two plasticizers may be contained as a component of the photosetting binder according to the present invention. Any solvent is not particularly necessary for preparing and/or using the photosetting binder according to the present invention.

In the process according to the present invention, after painting only the specified part of one of the surfaces of a sheet material with the above-mentioned binder, particularly before the thus painted binder solidifies, the microcapsules are adhered to the binder painted on the specified part of the surface of the sheet material, for instance, by using a rotatory drum or a sprayer.

As the microcapsules containing the solution of the colour former therewithin, dry powdery microcapsules are preferable. The amount of the microcapsules to be adhered to the sheet material is selected to give an appropriate colour density.

After adhering the microcapsules, the binder on the surface of the sheet material is solidified by an appropriate treatment, thereby fixing the microcapsules to the sheet material via the thus solidified binder. As the treatment for solidifying the binder, for instance, in the case of using the above-mentioned photosetting binder, exposure to ultraviolet light is preferable.

The recording paper which is partially pressure-sensitized according to the present invention has, in addition to the above-mentioned merits possessed originally by the recording paper which is partially pressure-sensitized, another merit that the surface of each microcapsule is not wholly covered by the binder. Accordingly, the demerits of the conventional recording paper which is partially pressure-sensitized, obtained by partially painting a sheet material with a slurry of the microcapsules dispersed in an organic solvent, namely, the reduction of breaking efficiency of the microcapsules on applying a pressure and the inhibition of transfer from CB sheet to CF sheet have been solved in the recording paper which is partially pressure-sensitized according to the present invention. As a result, an extremely high colour density is obtained, and in the case of obtaining the same colour density as in the conventional one, a smaller amount of the microcapsule suffices according to the present invention.

In addition, since no solvent is particularly necessary for painting the microcapsules on the surface of a sheet material, the recording paper of the present invention is profitable from the viewpoint of preventing environmental pollution.

The recording paper which is partially pressure-sensitized according to the present invention can be used, of course, as a CB sheet having the under surface thereof painted with the microcapsules and as a CBF sheet having the front surface thereof painted with a developer as well as the back surface thereof painted with the microcapsules.

In addition, the recording paper which is partially pressure-sensitized according to the present invention includes a composite pressure sensitive recording paper comprising a combination of a CF sheet of paper with a CB sheet of paper and/or a CBF sheet of paper, of course, other than one CB sheet of paper or one CBF sheet of paper.

The present invention will be explained more in detail while referring to the following non-limitative examples.

EXAMPLE 1

Preparation of the microcapsules used for producing the recording paper which is partially pressure-sensitized according to the present invention A mixture of 300 g of urea, 730 g of aqueous 37% solution of formaldehyde and 3 g of triethanolamine was reacted by heating for 60 min at 70° C. to prepare a prepolymer of ureaformaldehyde resin. After mixing 100 g of the thus prepared prepolymer with 20 g of Uramin ® P 1500 (aqueous 38% solution of a water-soluble cationic urea resin, made by Mitsui-Toatsu Co., Ltd.), 200 g of water and 10 g of aqueous 10% solution of triethanolamine, and adjusting the pH of the thus prepared mixture to 5.2 by the addition of aqueous 10% solution of citric acid, 3 g of aqueous 10% solution of sodium alkylbenzenesulfonate (Neoperex ®, made by Kao-Atlas Co., Ltd.) as an anionic surfactant were added to the thus adjusted mixture to obtain "A" liquid.

Separately, "B" liquid was obtained by dissolving 30 g of crystal violet lactone in 970 g of diisopropylnaphthalene, "B" liquid being a so-called "colour former solution".

Into the thus preparred "A" liquid, 150 ml of "B" liquid were emulsified as minute droplets of 2 to 8 micrometer in diameter, and the thus obtained aqueous emulsion was heated to 50° C. while gently stirring thereof, and the pH of the thus heated emulsion was adjusted to 2.8 by the addition of aqueous 10% solution of citric acid. After stirring the emulsion for 1 hour at 50° C., the emulsion was cooled to room temperature, and then stirred for another 10 hours to obtain an aqueous slurry-like material containing emulsified minute droplets as microcapsules. By filtering the slurry-like material with a membrane filter, the microcapsules were collected, washed with water and dried in a hot-air drier at 35° C. to obtain 210 g of powdery microcapsules.

EXAMPLE 2

Production of a recording paper which is partially pressure-sensitized

A photosetting binder of the following recipe was painted on a part (area of 10 $cm^2$) of one surface of a commercialized sheet material of fine quality of 40 $g/m^2$ at a rate of 3 $g/m^2$, and after spraying the powdery microcapsules obtained in Example 1 onto the thus partially painted surface of the sheet material from a distance of 30 cm, thereby adhering thereof to the painted part of the surface at a rate of 2 $g/m^2$ and the thus treated sheet material was exposed to an ultraviolet light of a wave length in a range of 200 to 400 nm from a high-pressure mercury lamp to solidify the binder adhered thereon, thereby fixing the microcapsules to the painted part of the surface of the sheet material. Thereafter, the microcapsules remaining on the surface except for the above-mentioned part of an area of 10 $cm^2$ were removed by an air flow and recovered to obtain a sheet of the recording paper which is partially pressure-sensitized according to the present invention.

Recipe of the photosetting adhesive substance 30 parts by weight of DRH-301.1 (epoxy diacrylate, made by Shell Co.),
20 parts by weight of trimethylolpropane triacrylate,
10 parts by weight of pentaerythriotol triacrylate,
20 parts by weight of N-vinylpyrrolidone,
12 parts by weight of benzophenone and
8 parts by weight of dimethylaminoethane.

COMPARATIVE EXAMPLE

A binder prepared by dispersing both 10 g of the powdery microcapsules obtained in Example 1 and 6 g of ethylcellulose in ethyl methyl ketone was painted on one surface of a sheet material of the same sort as in Example 2 to obtain a sheet of pressure sensitive recording paper.

EXAMPLE 3

After combining respectively (1) the recording paper which is partially pressure-sensitized obtained in Example 2 and (2) the pressure sensitive recording paper obtained in Comparative Example with a bright-developing paper (made by Kanzaki Paper Manufact. Co., Ltd.) in the respective sets, and developing each of the thus obtained composite recording papers by an electrotypewriter, the colour density of the respective products was determined by a McBeth colorimeter, the results being shown below.

| | MC 2.0 $g/m^2$ | |
|---|---|---|
| CB paper prepared in | Example 2 | Comparative Example |
| Colour density of the composite recording paper | 0.85 | 0.70 |

What is claimed is:

1. A recording paper which is partially pressure-sensitized, comprising microcapsules containing a solution of colorless color former, sheet material and binder, the microcapsules being fixed to a specified part of a surface of the sheet material via the binder, said binder being painted on the specified part and wherein a substantial portion of the fixed microcapsules have at least a part of the microcapsule exposed outside of the binder.

2. The recording paper according to claim 1, wherein the binder comprises a photosetting resin.

3. The recording paper according to claim 2, wherein said photosetting resin solidifies when exposed to a strong having a wavelength in the range of 200–400 nm.

4. The recording paper according to claim 3, wherein said photosetting resin contains as a major component an acrylic ester comprising a polyol acrylate selected from the group consisting of dimethylolpropane triacrylate, dimethylolpropane triacrylate, pentaerythritol triacrylate, pentaerythritol tetraacrylate and dipentaerythritol hexaacrylate; or an epoxyacrylate selected from the group consisting of bisphenol A glycidylether acrylate, modified bisphenol A epoxy acrylate, epoxydiacrylate or acrylates of epoxidized drying oil; and a polyacrylate carbamide.

5. The recording paper according to claim 4, wherein said photosetting resin further contains as a fluidity-adjusting agent, one or more substances selected from the group consisting of cyclohexyl acrylate, benzylacrylate, 2-ethylhexyl acrylate, 2-hydroxyethyl acrylate, styrene, N-methylolacrylamide, vinylacetate, N-vinylpyrrolidone, ethyleneglycol diacrylate, diethyleneglycol diacrylate, butyleneglycol acrylate, and 1,4-butanediol diacrylate; and one or more polymerization assistants selected from the group consisting of methyl o-benzoyl benzoate, thioxanthone, 2-chlorothioxanthone, p-dimethylaminobenzaldehyde, dimethylaminoethane, benzophenone and diethoxyacetophenone.

* * * * *